US005825129A

United States Patent [19]

Van der Leeuw et al.

[11] Patent Number: 5,825,129

[45] Date of Patent: Oct. 20, 1998

[54] HIGH PRESSURE DISCHARGE LAMP HAVING PIRCH SEALS

[75] Inventors: Bart Van der Leeuw, Turnhout, Belgium; Joseph E. Canale, Painted Post; Thomas W. Morris, Bath, both of N.Y.

[73] Assignee: U.S. Philips Corporation, New York, N.Y.

[21] Appl. No.: 743,594

[22] Filed: Nov. 4, 1996

[30] Foreign Application Priority Data

May 31, 1996 [EP] European Pat. Off. ..... 96201515

[51] Int. Cl.[6] ..... H01J 61/30; H01J 61/36

[52] U.S. Cl. ..... 313/634; 313/623; 313/332; 445/26; 445/43

[58] Field of Search ..... 313/634, 636, 313/623, 609, 631, 331, 332, 611, 285; 220/2.1 R; 445/26, 43

[56] References Cited

U.S. PATENT DOCUMENTS

| | | | |
|---|---|---|---|
| 5,062,116 | 10/1991 | Christensen | 313/636 |
| 5,142,195 | 8/1992 | Heider et al. | 313/634 |
| 5,500,570 | 3/1996 | Jeong | 313/634 |
| 5,528,101 | 6/1996 | Gosslar et al. | 313/493 |

FOREIGN PATENT DOCUMENTS 0451647 5/1995 European Pat. Off. .

*Primary Examiner*—Sandra L. O'Shea
*Assistant Examiner*—Joseph Williams
*Attorney, Agent, or Firm*—F. Brice Faller

[57] ABSTRACT

The high pressure discharge lamp has a quartz glass lamp vessel having two opposite pinch seals. The pinch seals have major faces which are tapering from an end face towards the discharge space and have raised ridges along their axial edges. The height of the ridges diminishes towards the end faces. The lamp vessel can be obtained from a cylindrical tube by pinching without prior processing.

10 Claims, 3 Drawing Sheets

HIGH PRESSURE DISCHARGE LAMP HAVING PIRCH SEALS

BACKGROUND OF THE INVENTION

The invention relates to a high-pressure discharge lamp with:

a quartz glass lamp vessel which is closed in a gastight manner, which has a longitudinal axis, and which has pinch seals arranged opposite one another on the axis and each having an end face, which seals bound a discharge space which contains an ionizable filling;

electrodes in the lamp vessel each connected to a current conductor which issues from the end face of a respective pinch seal to the exterior, which pinch seals have main surfaces facing away from one another and having a maximum dimension transverse to the axis which corresponds to a maximum transverse dimension of the lamp vessel at the area of the discharge space, and side faces facing away from one another, said main surfaces narrowing in an axial zone adjoining the discharge space.

Such a high-pressure discharge lamp is known from EP-B-0 451 647.

The lamp vessel of the lamps described in this document is obtained from a preshaped hollow quartz glass body which is open at both ends. This body is formed in that a tube of quartz glass, i.e. of a glass with an $SiO_2$ content of at least 96% by weight, is heated to the softening point between its ends, the central portion is shortened in that the ends of the tube are moved towards one another, and said portion is inflated in or against a mould. Depending on the desired diameter of the central portion, the heating, shortening and inflating steps have to be repeated once or several times. These operations are very time-consuming and require much expert supervision.

The fact that these operations known per se were carried out on the lamp shown in FIGS. 1 and 2 of the cited document follows from the described dimensions thereof. The lamp has an oval discharge space with a wall thickness of 2 to 2.5 mm and a greatest diameter of 36 mm. Nevertheless, the pinch seals have a thickness of no more than 4 mm, twice the wall thickness of the tube from which the pinch seal was made, for a width of the main surfaces of only 16 mm. The pinch seals also have ridges extending in axial direction and raised by approximately 1.5 mm on each of their main surfaces.

In the known lamp described in the opening paragraph, see FIGS. 5 and 6 of the cited document, it also follows from the described shape and dimensions that said operations were carried out. The discharge space is cylindrical with conical portions adjacent the pinch seals. The pinch seals are as wide as the cylindrical portion of the lamp vessel, and nevertheless flat and only 2 mm thick. If a cylindrical tube with a constant diameter were flattened, however, a plate would arise with a thickness twice the wall thickness of the tube and a width of approximately 1.57 ($\pi/2$) times the tube diameter.

Lamps having lamp vessels obtained in said process of heating, shortening and inflating in or against a mould, which process is possibly repeated, are expensive. This is caused not only by these operations, which are time-consuming and require much supervision, but also by the considerable length of quartz glass tubing which is necessary for it. The tube must be heated for a long time in its central portion with much fire in order to reach the temperature of at least approximately 1700° C. in order to deform it. The tube is held in a centered position by its ends during this, sealed off with rubbers on a compressed-gas line so that it can be inflated after softening. These rubbers must not be heated above a certain temperature, so the quartz glass tube under treatment must often have an extra length at both ends, which is cut off after shaping. In proportion as the axial length of the lamp vessel is smaller, the unavoidable quantity of wastage will be greater. The tube length required for manufacturing the lamp vessel may as a result be a multiple of the tube length utilized in the lamp vessel.

In the known lamp described in the opening paragraph, first pinching blocks form the main surfaces of the pinch seal, and second pinching blocks narrow said surfaces in the axial zone adjoining the discharge space. This narrowing leads to a local increase in the thickness of the pinch seal up to 4 mm. The pinching blocks also deform the discharge space and cause the discharge space to merge conically into the pinch seal, as seen in axial sections along straight lines.

It is useful when pinch seals are narrow at their connections to the discharge spaces. It is prevented thereby that seams formed in the glass during pinching in which ingredients of the ionizable filling may condense extend to comparatively far away from the electrode, which would cause said ingredients to be unavailable for the discharge. On the other hand, it is unfavorable when the discharge space behind an electrode adjoining a pinch seal, the electrode chamber, is conical, i.e. narrow, because a convection flow which could cause condensed ingredients of the filling to evaporate will be hampered there.

SUMMARY OF THE INVENTION

It is an object of the invention inter alia to provide a high-pressure discharge lamp of the kind described in the opening paragraph which is of a simple construction which is easy to manufacture.

According to the invention, this object is achieved in that the main surfaces of the pinch seals widen in a direction away from the discharge space up to at least substantially the end face and have raised ridges along their axial edges whose height diminishes towards the end face.

It is essential for the lamp according to the invention that the lamp vessel can be directly manufactured from a straight piece of glass tubing, possibly with an exhaust tube fused thereto laterally, in that pinch seals are provided in this glass tube. The operations of heating a central tube portion, collecting glass therein by shortening of the tube, and inflating said portion are thus avoided, while nevertheless the connection between the pinch seal and the discharge vessel is comparatively narrow in relation to the discharge space.

The pinch seal is obtained in that an end portion of a tube is heated to its pinching temperature, approximately 1700° C., and said portion is pinched by means of substantially trapezoidal pinching blocks which are substantially flat, apart from, for example, recesses for current conductors. The flat portions of the main surfaces of a pinch seal are obtained thereby. The bases of the trapezoidal pinching blocks will lie adjacent the end faces of the seals. The pinching blocks are considerably narrower than half the tube circumference, so that open folds will be present on either side of the pinching blocks extending into the discharge space. Such open folds would also be present with the use of rectangular pinching blocks with a width corresponding to the shortest parallel side of the trapezoidal pinching blocks. The folds are subsequently flattened by second pinching blocks approaching from the side. The pinch seal must be made vacuumtight during this. It is in addition necessary to avoid that gas bubbles become entrapped in the folds. This is a risk when rectangular pinching blocks are used.

The trapezoidal shape of the first pinching blocks, and thus of the main surface of the pinch seal, renders it possible to drive gas present in the folds towards the end face by means of the second pinching blocks. The folds are converted into ridges along the axial edges of the main surfaces during this.

The shape of the pinches has the important advantage that light generated by the discharge can be emitted at small angles to the axis without hitting the pinch seal. Another advantage is that the pinch seal has a comparatively large surface area, also for a comparatively small axial dimension, so that it can easily remove heat from the current conductor, and the current conductors can issue to the exterior in a comparatively cool state, i.e. better resistant to corrosion.

In a favorable embodiment, the discharge space is circumferentially curved in axial direction laterally of the electrodes. This embodiment has the advantage that the discharge space is comparatively spacious and wide laterally of the electrodes, so that a convection flow can easily arise. This embodiment may be realized in that it is ensured that the pinching blocks in making the pinch seal do carry along the glass adjoining said seal in the direction of the axis, but do not or substantially not touch this glass.

In a favorable modification of the lamp according to the invention, channels extend between the ridges along the axial edges in an axial zone adjoining the end face of each pinch seal, which channels narrow in a direction away from the end face. The second pinching blocks then have exerted a greater pressure adjacent the discharge space than adjacent the end face, with the result that cavities in the pinch seals adjacent the discharge space are avoided.

The lamp according to the invention may often be used without a coating on the lamp vessel around the electrodes which reflects heat radiation. A process step for providing a coating and the interception of light by a coating are then both avoided.

The lamp according to the invention may be accommodated in an outer envelope, but may alternatively be used without such an envelope, for example be held in a lamp cap, for example a ceramic lamp cap.

It is favorable when the raised ridges have an average dimension parallel to the main surfaces of the pinch seal which corresponds to the distance between the main surfaces. This distance is approximately twice the wall thickness of the discharge space.

BRIEF DESCRIPTION OF THE DRAWINGS

An embodiment of the high-pressure discharge lamp according to the invention is shown in the drawing, in which.

DESCRIPTION OF THE PREFERRED EMBODIMENTS

Figure 1:
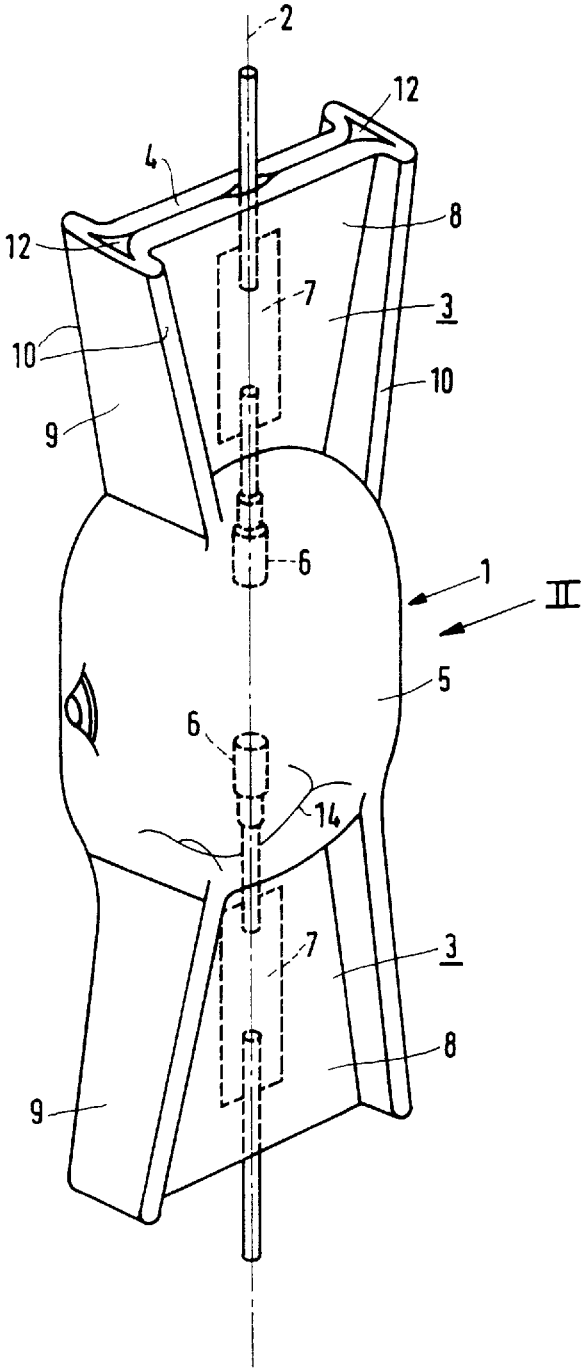
FIG. 1 shows the high-pressure discharge lamp in perspective view.

In FIG. 1, the high-pressure discharge lamp has a quartz glass lamp vessel 1 closed in a gastight manner and having a longitudinal axis 2 and two pinch seals 3 each with an end face 4 arranged in mutual opposition on the axis 2, which seals bound a discharge space 5 containing an ionizable filling. The lamp vessel in the Figure is filled with mercury, rare gas, and halides of dysprosium, holmium, gadolinium, neodymium, and cesium. Electrodes 6 are arranged in the lamp vessel and connected to current conductors 7 which issue to the exterior each from the end face 4 of a respective pinch seal 3. The pinch seals 3 have main surfaces 8 facing away from one another and having a maximum dimension transverse to the axis 2 which corresponds to a maximum transverse dimension of the lamp vessel 1 at the area of the discharge space 5, as well as side faces 9 facing away from one another. The main surfaces 8 narrow in an axial zone adjoining the discharge space 5.

Figure 3:
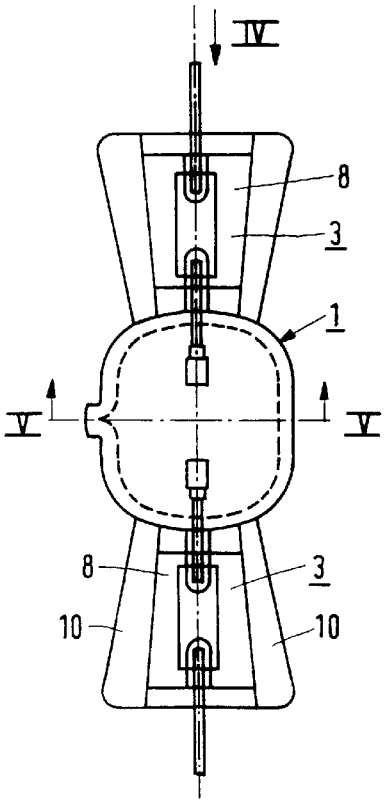
FIG. 3 is an elevation of the lamp viewed along III in FIG. 2.

The main surfaces 8 of the pinch seals 3 widen in a direction away from the discharge space 5 up to at least substantially the end faces 4 and have raised ridges 10 along their axial edges 13, see FIG. 3, which ridges diminish in height, i.e. a dimension transverse to the main surfaces 8, in a direction towards the end faces 4.

The lamp vessel was obtained from a straight quartz glass tube of constant diameter and wall thickness in that pinch seals 3 as shown were provided in end portions thereof. Substantially trapezoidal pinching blocks, see also FIG. 3, shaping the main surfaces 8 were used for this. The pinching blocks were flat apart from recesses in one of each set for accommodating ends of the rod-type inner and outer portions of the current conductor 7 embedded in the pinch seal. The raised ridges 10 were subsequently formed by the second pinching blocks, see also FIG. 3. The discharge space 5 was given its convex shape during this without the pinching blocks substantially making contact with the wall thereof. The pinch seals 3 have a comparatively large surface area per axial unit length, so that the current conductors 7 issue to the exterior in a comparatively cool state in the case of a comparatively small axial dimension already.

Figure 2:
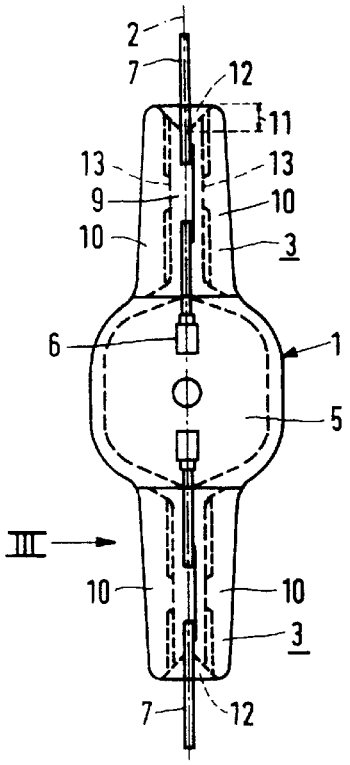
FIG. 2 is an elevation of the lamp viewed along II in FIG. 1.

It is apparent from FIGS. 2 and 3 that the discharge space 5 is circumferentially curved in axial direction laterally of the electrodes 6, and is spacious and wide, so that convection flows in the lamp can easily carry away condensed filling ingredients.

Figure 5:
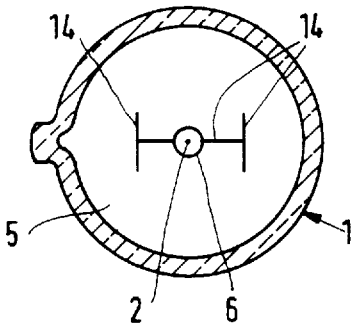
FIG. 5 is a cross-section taken on V—V in FIG. 3.

FIG. 5 shows the shallow seams 14 in the wall around the discharge space 5 which have arisen during pinching. The seam 14 passing through the axis 2 was formed by the first pinching blocks, the two shorter seams 14 by the second pinching blocks. FIG. 5 shows that the seams 14 extend up to only a small distance away from the current conductor 7, so that they are comparatively hot during lamp operation. The seam 14 through the axis 2 would extend over the entire tube diameter if first pinching blocks of the same width as the tube diameter had been used. FIGS. 2 and 3 show that the seams 14 are of so small a depth that they are not discernible there. It is hardly possible for ingredients of the ionizable filling to condense there. It may also be deduced from these Figures that the seams 14 extend in axial direction over a small distance only.

Channels 12 are present between the raised ridges 10 along the axial edges 13 in an axial zone 11, see FIG. 2, adjoining the end face 4 of each pinch seal 3, which channels narrow in a direction away from the end face 14. These channels are also vissible in the elevation of FIG. 4. Such channels are absent adjacent the discharge space 5, and also in an axial central zone of each pinch seal 3, so that the pinch seals are vacuumtight.

Figure 4:
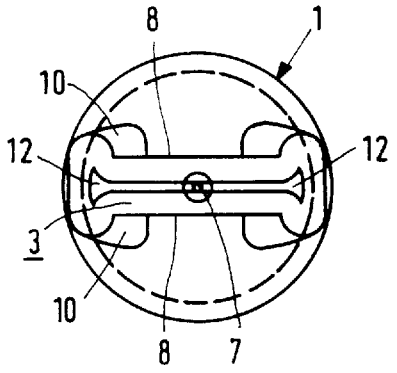
FIG. 4 is an elevation of the lamp viewed along IV in FIG. 3.

The raised ridges 10, cf. FIGS. 3 and 4, have an average dimension parallel to the main surfaces 8 of the pinch seal 3 which corresponds to the distance between the main surfaces 8.

The lamp shown in the Figures ($L_{inv}$) consumed a power of 1200 W during operation. The lamp was compared with a lamp ($L_{ref}$) of equal power and with the same filling, but different only in that it was manufactured with a lamp vessel which was obtained from a straight quartz glass tube through heating, shortening, and inflating against a mould. This discharge space had a spherical shape.

The luminous efficacy (η) of the lamps and the color coordinates (x,y) of the generated light were measured. The lamps were also operated in a luminaire, and the color temperature in the center ($T_c$) of an illuminated screen was compared with said temperature at the edge ($T_r$) and also with said temperature half-way between the center and the edge ($T_m$). The results are given Table 1.

TABLE 1

| | $L_{inv}$ | $L_{ref}$ |
|---|---|---|
| η (lm/W) | 84 | 82 |
| x;y | 304; 324 | 307; 325 |
| $T_c$–$T_r$ (K) | 450 | 800 |
| $T_c$–$T_m$ (K) | 250 | 400 |

It is apparent from Table 1 that the lamp according to the invention has the same color point and at least the same luminous efficacy as the reference lamp. It is also found that the lamp illuminates a screen with a higher homogeneity of color.

We claim:

1. A high-pressure discharge lamp comprising:

a quartz glass lamp vessel which is closed in a gastight manner, which has a longitudinal axis, and which has pinch seals arranged opposite one another on the axis and each having an end face, which seals bound a discharge space which contains an ionizable filling;

electrodes in the lamp vessel each connected to a current conductor which issues from the end face of a respective pinch seal to the exterior, which pinch seals have main surfaces facing away from one another and having a maximum dimension transverse to the axis which corresponds to a maximum transverse dimension of the lamp vessel at the area of the discharge space, and side faces facing away from one another, said main surfaces narrowing in an axial zone adjoining the discharge space, characterized in that the main surfaces of the pinch seals widen in a direction away from the discharge space up to at least substantially the end face and have raised ridges along their axial edges whose height diminishes towards the end face.

2. A high-pressure discharge lamp as claimed in claim 1, characterized in that the discharge space is circumferentially curved in axial direction laterally of the electrodes.

3. A high-pressure discharge lamp as claimed in claim 2, characterized in that channels are present between the raised ridges along the axial edges in an axial zone adjacent the end face of each pinch seal, which channels narrow in a direction away from the end face.

4. A high-pressure discharge lamp as claimed in claim 3, characterized in that the raised ridges have an average dimension parallel to the main surfaces of the pinch seal which corresponds to the distance between the main surfaces.

5. A high-pressure discharge lamp as claimed in claim 1, characterized in that channels are present between the raised ridges along the axial edges in an axial zone adjacent the end face of each pinch seal, which channels narrow in a direction away from the end face.

6. A high-pressure discharge lamp as claimed in claim 1, characterized in that the raised ridges have an average dimension parallel to the main surfaces of the pinch seal which corresponds to the distance between the main surfaces.

7. A high-pressure discharge lamp as claimed in claim 2, characterized in that the raised ridges have an average dimension parallel to the main surfaces of the pinch seal which corresponds to the distance between the main surfaces.

8. A high pressure discharge lamp comprising a quartz glass lamp vessel which is closed in a gas-tight manner and has a longitudinal axis and pinch seals arranged opposite one another on the axis, said seals bounding a discharge space which contains an ionizable filling, each pinch seal having an end face opposite said discharge space, a pair of electrodes in the lamp vessel, each electrode connected to a current conductor which passes through a respective said pinch seal and issues from the end face to the exterior, said pinch seals each having a pair of main surfaces facing away from one another and a pair of raised ridges flanking each said main surface, said raised ridges defining a width of said main surfaces therebetween, the width of each said main surface increasing at least substantially continuously in a direction away from the discharge space up to at least substantially the end face, said raised ridges each having a height above said main surface, said height decreasing at least substantially continuously from the discharge space toward the end face.

9. A high pressure discharge lamp as in claim 8 wherein said main surfaces have a maximum width transverse to said axis which is less than a maximum transverse dimension of said lamp vessel.

10. A high pressure lamp as in claim 8 wherein each raised ridge flanking each main surface is directly opposed from a raised ridge on the oppositely facing surface, said lamp further comprising a channel between each pair of opposed raised ridges, each channel narrowing in a direction away from the respective end face.

* * * * *